US006256053B1

(12) United States Patent
Noshita

(10) Patent No.: US 6,256,053 B1
(45) Date of Patent: Jul. 3, 2001

(54) THERMAL HEAD

(75) Inventor: Taihei Noshita, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/534,567

(22) Filed: Mar. 27, 2000

(30) Foreign Application Priority Data

Mar. 25, 1999 (JP) ..... 11-082025

(51) Int. Cl.[7] ..... B41J 2/335
(52) U.S. Cl. ..... 347/203
(58) Field of Search ..... 347/203, 200

(56) References Cited

FOREIGN PATENT DOCUMENTS 61-53955 11/1986 (JP) ..... B41J/3/20
7-132628 5/1995 (JP) ..... B41J/2/2335
10-217520 * 8/1998 (JP) ..... B41J/2/335
11-070682 * 3/1999 (JP) ..... B41J/2/335
11-078092 * 3/1999 (JP) ..... B41J/2/335

* cited by examiner

*Primary Examiner*—Huan Tran
(74) *Attorney, Agent, or Firm*—Sughrue, Mion, Zinn, Macpeak & Seas, PLLC

(57) ABSTRACT

A thermal head has a protective coating of heating elements. The protective coating includes an insulating protective layer and an electrically conductive protective layer formed above the insulating protective layer. The electrically conductive protective layer covers at least a region of the insulating protective layer under which an under-glaze heat-accumulating layer is located and does not overlie at least one of the negative and positive electrode layers in other regions than the region. The thermal head can prevent abnormal current flow due to pinholes of the insulating protective layer formed under the electrically conductive protective layer, exhibit high reliability over an extended period of time and perform thermal recording of high-quality images consistently over an extended period of operation.

5 Claims, 2 Drawing Sheets

THERMAL HEAD

BACKGROUND OF THE INVENTION

This invention relates to the art of thermal heads for thermal recording which are used in various types of printers, plotters, facsimile, recorders and the like as a recording device.

Thermal materials comprising a thermal recording layer on a substrate of a film or the like are used to record images produced in diagnosis by ultrasonic scanning (sonography).

This recording method, also referred to as thermal recording, eliminates the need for wet processing and offers several advantages including convenience in handling. Hence in recent years, the use of the thermal recording system is not limited to small-scale applications such as diagnosis by ultrasonic scanning and an extension to those areas of medical diagnoses such as CT, MRI and X-ray photography where large and high-quality images are required is under review.

As is well known, thermal recording involves the use of a thermal head having a glaze, in which heating elements comprising a heat-generating resistor and electrodes, used for heating a thermal material to record an image are arranged in one direction (main scanning direction) and, with the glaze urged at small pressure against the thermal material, the two members are moved relative to each other in an auxiliary scanning direction perpendicular to the main scanning direction, and energy is applied to the heating elements of the respective pixels in the glaze in accordance with image data to be recorded which were supplied from an image data supply source such as MRI or CT in order to heat the thermal recording layer of the thermal material, thereby performing image recording through color formation.

A protective coating is formed on the surface of the glaze of the thermal head in order to protect the heating elements and the like. Therefore, it is this protective coating that contacts the thermal material during thermal recording and the heat-generating resistor heats the thermal material through this protective coating so as to perform thermal recording.

The protective coating is usually made of wear-resistant ceramics; however, during thermal recording, the surface of the protective coating is heated and kept in sliding contact with the thermal material, so it will gradually wear and deteriorate upon repeated recording.

If the wear of the protective coating progresses, density unevenness will occur on the thermal image or a desired protective strength can not be maintained and, hence, the ability of the coating to protect the heat-generating resistor is impaired to such an extent that the intended image recording is no longer possible (the head has lost its function).

Particularly in the applications such as the aforementioned medical use which require multiple gradation images of high quality, the trend is toward ensuring the desired high image quality by adopting thermal films with highly rigid substrates such as polyester films and also increasing the setting values of recording temperature (energy applied) and of the pressure at which the thermal head is urged against the thermal material. Under these circumstances, as compared with the conventional thermal recording, a greater force and more heat are exerted on the protective coating of the thermal head, making wear and corrosion (or wear due to corrosion) more likely to progress.

With a view to preventing the wear of the protective coating on the thermal head and improving its durability, a number of techniques to improve the performance of the protective coating have been considered. Among others, a carbon-based protective coating (hereinafter referred to as a carbon protective layer) is known as a protective coating excellent in resistance to wear and corrosion.

Thus, Examined Published Japanese Patent Application (KOKOKU) No. 61-53955 discloses a thermal head excellent in wear resistance and response which is obtained by forming a very thin carbon protective layer having a Vickers hardness of 4500 kg/mm$^2$ or more as the protective coating of the thermal head. Unexamined Published Japanese Patent Application (KOKAI) No. 7-132628 discloses a thermal head which has a two-layered protective coating comprising a lower silicon-based ceramic protective layer and an overlying diamond-like carbon layer, the protective coating having wear and breakage significantly reduced, thereby ensuring that high-quality images can be recorded over an extended period of time.

As shown in FIG. 3, the heating element of the thermal head usually comprises an under-glaze heat-accumulating layer 102 (hereinafter referred to as "heat-accumulating layer") formed on a substrate 100, a heat-generating resistor 104 overlaid on the heat-accumulating layer 102, and a positive electrode layer 106 and a negative electrode layer 108 formed on the substrate 100 and the heat-accumulating layer 102.

The heating element is coated with a protective coating. In the case of the two-layered structure described above, the heating element is coated with a ceramic protective layer 110, which in turn is coated with a carbon protective layer 112.

The substrate 100 is made of a material such as alumina. The substrate 100 has usually fine irregularities that are reflected on the region of the electrode layers neighboring the substrate 100.

The ceramic protective layer 110 and the carbon protective layer 112 formed on the electrode layers 106, 108 are usually formed by film deposition techniques including sputtering and chemical vapor deposition (CVD), but may often have pinholes 114*a, b* or cracks due to the irregularities of the electrode layers 106, 108.

The carbon protective layer 112 has a high electric conductivity. Thus, if the ceramic protective layer 110 has the pinholes 114*a*, 114*b* or cracks, the current for driving the thermal head does not pass through the heat-generating resistor 104 having low electric conductivity, but enters the carbon protective layer 112 through the pinhole 114*a* in the ceramic protective layer 110 located on the positive electrode layer 106 side, passes therethrough, and reaches the negative electrode layer 108 through the pinhole 114*b* in the ceramic protective layer 110 located on the negative electrode layer 108 side.

The pinholes 114*a*, 114*b* are small holes. Under such a phenomenon, a large amount of energy is applied to a portion of the electrode layers due to concentration of electric charges, which may often damage the electrode layers. The electrode layers (heating elements) are damaged for several dots to such an extent that the thermal head has lost its function.

Even if the electrode layers are not damaged, an excessive current runs without passing through the heat-generating resistor 104, which results in a damage of various devices including IC used for driving the thermal head.

SUMMARY OF THE INVENTION

The present invention has been accomplished under these circumstances and has as an object providing a thermal head, having an electrically conductive protective layer such as a carbon protective layer, that can prevent abnormal current flow due to pinholes of the insulating protective layer formed under the electrically conductive protective layer, exhibit high reliability over an extended period of time and perform thermal recording of high-quality images consistently over an extended period of operation.

In order to achieve the above object, the invention provides a thermal head having heating elements, negative and positive electrode layers on the heating elements, a protective coating of the heating elements and an under-glaze heat-accumulating layer under the heating elements, the protective coating comprising:

an insulating protective layer, and an electrically conductive protective layer formed above the insulating protective layer, wherein the electrically conductive protective layer covers at least a region of the insulating protective layer under which the under-glaze heat-accumulating layer is located and does not overlie at least one of the negative and positive electrode layers in other regions than the region.

In a preferred embodiment, the insulating protective layer and the electrically conductive protective layer are based on ceramics and carbon, respectively.

In another preferred embodiment, the thermal head further comprises an intermediate layer provided between the insulating protective layer and the electrically conductive protective layer.

DETAILED DESCRIPTION OF THE INVENTION

The thermal head of the invention will now be described in detail with reference to the preferred embodiments shown in the accompanying drawings.

Figure 1A:
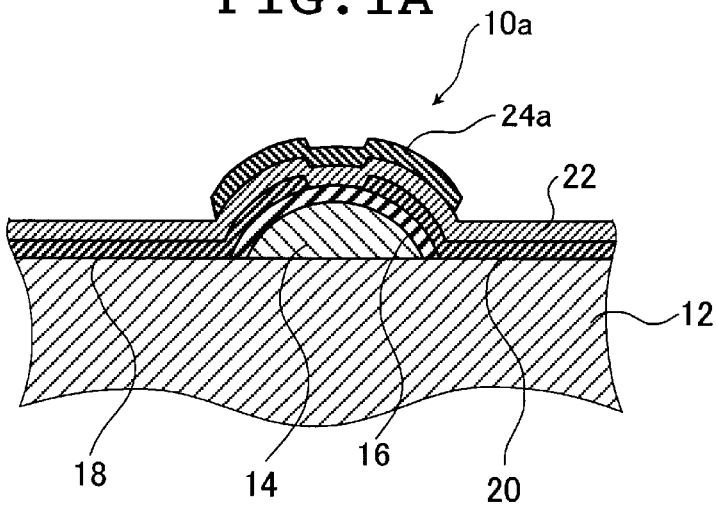
FIGS. 1A, 1B and 1C are schematic cross sectional views each showing the structure of a heating element in the thermal head of the invention.
Figure 1B:
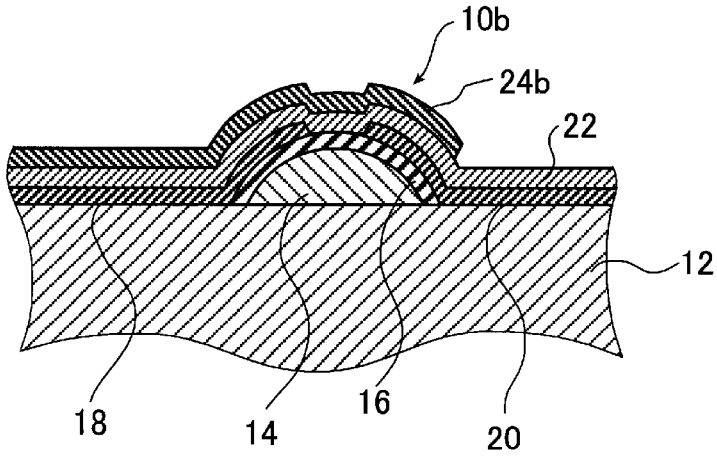
Figure 1C:
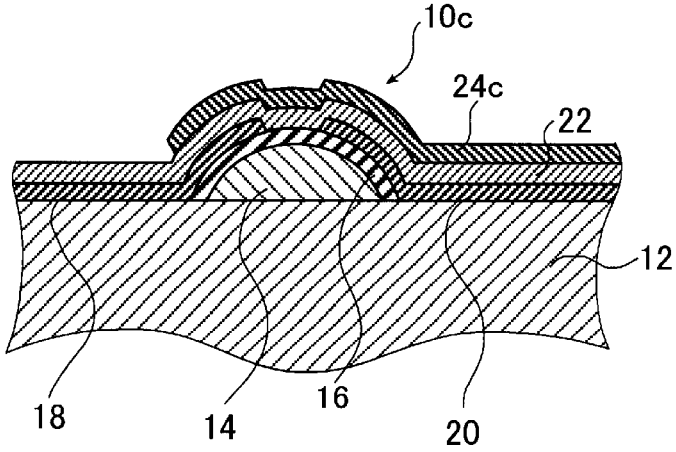

FIGS. 1A, 1B and 1C show schematic cross sectional views of a heating element in the thermal head of the invention.

The thermal heads 10*a*, 10*b* and 10*c* shown in FIGS. 1A, 1B and 1C are capable of recording on thermal sheets of up to, for example, B4 size at a recording (pixel) density of, say, about 300 dpi. Except for the protective coating, the heads have a known structure in that heating elements performing thermal recording on a thermal material are arranged in one direction, that is in a main scanning direction (which is normal to the plane in FIGS. 1A, 1B and 1C).

It should be noted that the thermal head 10*a*, 10*b* or 10*c* of the invention is not particularly limited in such aspects as the width (in the main scanning direction), resolution (recording density) and recording gradation; preferably, the head width ranges from 5 cm to 50 cm, the resolution is at least 6 dots/mm (ca. 150 dpi), and the recording gradation consists of at least 256 levels.

As shown in FIG. 1, the thermal head 10*a*, 10*b* or 10*c* (or the glaze thereof) comprises an under-glaze heat-accumulating layer (hereinafter simply referred to as "heat-accumulating layer") 14 formed on the top of a substrate 12 (which is shown to face down in FIGS. 1A, 1B and 1C since the thermal head 10*a*, 10*b* or 10*c* is pressed downward against the thermal material), a heater (heat-generating resistor) 16 formed on the heat-accumulating layer 14, a positive (common) electrode layer 18 and a negative (ground) electrode layer 20 formed on the left side and right side in the figures, respectively, and a protective coating formed to protect the heating elements comprising the heater 16 and the electrode layers 18, 20.

The protective coating in the illustrated thermal head 10*a*, 10*b* or 10*c* is composed of two layers: a lower protective layer 22 that is an insulating protective layer entirely overlying the heating elements and an electrically conductive carbon-based protective layer 24*a*, 24*b* or 24*c* formed on the lower protective layer 22.

The thermal head 10*a*, 10*b* or 10*c* of the invention has essentially the same structure as known versions of thermal head except for the protective coating. Therefore, the arrangement of other layers and the constituent materials of the respective layers are not limited in any particular way and various known versions may be employed. Specifically, the substrate 12 may be formed of various electrical insulating materials including heat-resistant glass and ceramics such as alumina, silica and magnesia; the heat-accumulating layer 14 may be formed of heat-resistant glass, heat resistant resins including polyimide resin and the like; the heater 16 may be formed of heat-generating resistors such as Nichrome (Ni—Cr), tantalum metal and tantalum nitride; and the positive and negative electrode layers 18, 20 may be formed of electrically conductive materials such as aluminum, gold, silver and copper.

Heating elements on the glaze are known to be available usually in two types, one being of a thin-film type which is formed by a "thin-film" process such as vacuum deposition, chemical vapor deposition (CVD) or sputtering and a photoetching technique, and the other being of a thick-film type which is formed by "thickfilm" process comprising the steps of printing (e.g., screen printing) and firing. The thermal head 10*a*, 10*b* or 10*c* for use in the invention may be formed by either method.

In the illustrated case, the whole surface of the heat-accumulating layer 14 is covered with the heater 16, but this is not the sole case of the invention and the heater 16 may be formed only on the region that comes in contact with the thermal material.

The lower protective layer 22 on the thermal head 10*a*, 10*b* or 10*c* of the invention may be formed of a variety of known materials as long as they have insulating properties and sufficient heat resistance, corrosion resistance and wear resistance to serve as the protective coating of the thermal head. Various ceramic materials are preferably used.

Specific materials include silicon nitride ($Si_3N_4$), silicon carbide (SiC), tantalum oxide ($Ta_2O_5$), aluminum oxide ($Al_2O_3$), SIALON (Si—Al—O—N), LASION (La—Si—O—N), silicon oxide ($SiO_2$), aluminum nitride (AlN), boron nitride(BN), selenium oxide (SeO), titanium nitride (TiN), titanium carbide (TiC), titanium carbide nitride (TiCN), chromium nitride (CrN) and mixtures thereof. Among these, nitrides and carbides are preferably used in such aspects as easy film deposition, manufacturing cost, and resistance to mechanical wear and chemical wear. Silicon nitride, silicon carbide and SIALON are more preferably used. Additives such as metals may be incorporated in small amounts into the lower protective layer 22 to adjust physical properties thereof.

Methods of forming the lower protective layer 22 are not limited in any particular way and known methods of forming ceramic films (layers) such as sputtering, especially magnetron sputtering, and CVD, especially plasma-assisted CVD may be employed by applying the aforementioned thick-film and thin-film processes and the like. Among these, CVD is preferably employed.

As is well known, CVD is a technique of film deposition in which thermal or optical energy is applied to gaseous materials in a reaction chamber to induce various chemical reactions, thereby depositing substances on the substrate. The lower protective layer 22 which is very fine and has no defects such as cracks can be formed by means of CVD, whereupon a thermal head excellent in durability and advantageous in image quality can be obtained.

The lower protective layer 22 may comprise multiple sub-layers. In this case, the multiple sub-layers may be formed of different materials or multiple sub-layers different in density may be formed of one material. Alternatively, the two methods may be combined to obtain sub-layers.

In the thermal head 10*a*, 10*b* or 10*c* of the invention, the carbon protective layer 24*a*, 24*b* or 24*c* is formed on the lower protective layer 22 described above. However, the thermal head 10*a*, 10*b* or 10*c* may have a protective coating of three-layered structure, in which the carbon protective layer 24*a*, 24*b* or 24*c* is formed after an intermediate protective layer (hereinafter referred to as "intermediate layer") is optionally formed on the lower protective layer 22.

As described above, a thermal head having an significantly prolonged service life can be obtained by forming the lower protective layer 22 and the carbon protective layer 24*a*, 24*b* or 24*c*. If the intermediate layer 22 is further inserted therebetween, the adhesion of the lower protective layer 22 to the carbon protective layer 24*a*, 24*b* or 24*c* and the shock absorption can be improved, thereby providing a thermal head with more prolonged service life and which is more excellent in durability and long term reliability.

The intermediate layer 22 formed on the thermal head 10*a*, 10*b* or 10*c* is preferably based on at least one component selected from the group consisting of metals in Group IVA (titanium group), Group VA (vanadium group) and Group VIA (chromium group) of the periodic table, as well as silicon (Si) and germanium (Ge) in such aspects as the adhesion to the upper carbon protective layer 24*a*, 24*b* or 24*c* and the lower protective layer 22 and the durability of the carbon protective layer 24*a*, 24*b* or 24*c*.

Preferred specific examples include Si, Ge, titanium (Ti), tantalum (Ta), molybdenum (Mo) and mixtures thereof. Among these, Si and Mo are more preferably used in the binding with carbon and other aspects. Most preferably, Si is used.

Methods of forming the intermediate layer 22 are not limited in any particular way and any known film deposition methods may be used in accordance with the material of the intermediate layer 22 by applying the aforementioned thick-film and thin-film processes and the like. The intermediate layer 22 may also comprise multiple sub-layers.

If the intermediate layer to be formed on the thermal head 10*a*, 10*b* or 10*c* of the invention is electrically conductive, it is preferred that this layer also covers at least the region of the lower protective layer 22 under which the heat-accumulating layer 14 is located, and does not overlie, in other regions than the region, at least one of the positive and negative electrode layers 18, 20, as in the carbon protective layer 24*a*, 24*b* or 24*c*.

As described above, the thermal head 10*a*, 10*b* or 10*c* of the invention has the electrically conductive carbon-based protective layer 24*a*, 24*b* or 24*c* formed on the lower protective layer 22.

The carbon-based protective layer 24*a*, 24*b* or 24*c* as used in the present invention refers to a carbon layer containing not less than 50 atm % of carbon, and preferably comprising carbon and inevitable impurities. In the thermal head 10*a*, 10*b* or 10*c* of the invention, suitable components to be incorporated in addition to carbon to form the carbon protective layer 24*a*, 24*b* or 24*c* include hydrogen, nitrogen, fluorine, Si and Ti. In the case of hydrogen, nitrogen and fluorine, the content thereof in the carbon protective layer 24*a*, 24*b* or 24*c* is preferably less than 50 atm %, and in the case of Si and Ti, the content thereof in the carbon protective layer 24*a*, 24*b* or 24*c* is preferably not more than 20 atm %.

In the present invention, the electrically conductive protective layer formed on the lower protective layer 22 is not limited to the carbon protective layer 24*a*, 24*b* or 24*c*, and various hard layers that are electrically conductive and has sufficient mechanical strength and heat resistance to serve as the protective layer of the thermal head may be used.

Specifically, a protective layer made of titanium nitride (TiN) or tinanium carbide (TiC) is illustrated.

In the present invention, the carbon protective layer 24*a*, 24*b* or 24*c* (conductive protective layer formed on the insulating protective layer) covers at least the region of the lower protective layer 22 under which the heat-accumulating layer 14 is located. As for the other regions in which the heat-accumulating layer 14 is not provided, the carbon protective layer 24*a*, 24*b* or 24*c* is formed not so as to overlie at least one of the negative and positive electrode layers 18, 20.

The carbon protective layer 24*a*, 24*b* or 24*c* can be used in various forms as described below, if the above definition is fulfilled.

In the thermal head 10*a*shown in FIG. 1A, the carbon protective layer 24*a* is only formed on the region of the lower protective layer 22 under which the heat-accumulating layer 14 is formed.

In the thermal head 10*b* shown in FIG. 1B, the carbon protective layer 24*b* is formed not only on the region of the lower protective layer 22 under which the heat-accumulating layer 14 is formed as shown in the thermal head 10*a* above, but also on the region of the lower protective layer 22 under which the positive electrode layer 18 is formed.

Further, in the thermal head 10*c* shown in FIG. 1C, the carbon protective layer 24*c* is formed not only on the region of the layer 22 under which the heat-accumulating layer 14 is formed as shown in the thermal head 10*a* above, but also on the region of the layer 22 under which the negative electrode layer 20 is formed.

Namely, the thermal head 10*a*, 10*b* or 10*c* of the invention forms the carbon protective layer 24*a*, 24*b* or 24*c* on the lower protective layer 22 so that the regions in which the positive electrode layer 18 and the negative electrode layer 20 are directly formed on the substrate 12 are not connected to each other beyond the region of the heat-accumulating layer 14 through the carbon protective layer 24*a*, 24*b* or 24*c*. Hence, even if pinholes are formed in the lower protective layer 22 on both the positive and negative electrode layers 18, 20, they are not connected to each other through the carbon protective layer 24*a*, 24*b* or 24*c*.

Therefore, the thermal head 10*a*, 10*b* or 10*c* of the invention prevents abnormal current from flowing from the pinholes in the lower protective layer 22 located on the positive electrode layer 18 side into the carbon protective layer 24*a*, 24*b* or 24*c*, passing therethrough and reaching the negative electrode layer 20 via the pinholes in the lower protective layer located on the negative electrode layer 20 side. Thus, breakage of the electrode layers and adverse effects on various devices including drive IC due to the occurrence of abnormal current flow can be eliminated to thereby fabricate a thermal head having a high reliability over an extended period of time.

In some cases, pinholes are formed in the region of the lower protective layer 22 under which the heat-accumulating layer 14 is formed. However, in an ordinary type of thermal head, the surface of the heat-accumulating layer 14 is much smoother than that of the substrate 12. Then, the pinholes formed in this region are so fine that the drive current of the thermal head cannot run therethrough and do not cause any problems.

The hardness of the carbon protective layer 24*a*, 24*b* or 24*c* is not limited to any particular value as far as the carbon protective layer 24*a*, 24*b* or 24*c* has a sufficient hardness to serve as the protective coating of the thermal head. Thus, the carbon protective layer 24*a*, 24*b* or 24*c* having a Vickers hardness of about from 3000 kg/mm$^2$ to 5000 kg/mm$^2$ is advantageously illustrated. The hardness may be constant or varied in the thickness direction of the carbon protective layer 24*a*, 24*b* or 24*c*. In the latter case, the hardness variation may be continuous or stepwise.

The lower protective layer 22 and the carbon protective layer 24*a*, 24*b* or 24*c* in the thermal head 10*a*, 10*b* or 10*c* of the invention are not limited in thickness to any particular values. The lower protective layer 22 has preferably a thickness of from 0.5 $\mu$m to 50 $\mu$m, especially from 2 $\mu$m to 20 $\mu$m, and the carbon protective layer 24*a*, 24*b* or 24*c* has preferably a thickness of from 0.1 $\mu$m to 5 $\mu$m, especially from 1 $\mu$m to 3 $\mu$m, in such an aspect that wear resistance and heat conductivity (or recording sensitivity) can be balanced with advantage.

When the intermediate layer is inserted therebetween, the thickness of the lower protective layer 22 is preferably in the range of from 0.2 $\mu$m to 20 $\mu$m, especially from 2 $\mu$m to 15 $\mu$m, that of the intermediate layer in the range of from 0.05 $\mu$m to 1 $\mu$m, especially from 0.1 $\mu$m to 1 $\mu$m, and that of the carbon protective layer 24*a*, 24*b* or 24*c* in the range of from 0.5 $\mu$m to 5 $\mu$m, especially from 1 $\mu$m to 3 $\mu$m. In the case of the intermediate layer that is much thicker than the carbon protective layer 24*a*, 24*b* or 24*c*, cracking and delamination may often take place in the intermediate layer. When the intermediate layer is much thinner than the carbon protective layer 24*a*, 24*b* or 24*c*, the intermediate layer cannot exhibit sufficient functions to be performed as the intermediate layer. Therefore, if the thicknesses of the intermediate layer and the carbon protective layer 24*a*, 24*b* or 24*c* are within the stated ranges, the adhesion of the intermediate layer to the lower protective layer 22 and the shock absorption thereof as well as the functions of the carbon protective layer 24*a*, 24*b* or 24*c* including durability can be consistently realized in a well balanced manner.

After the carbon protective layer 24*a*, 24*b* or 24*c* is formed, a lubricant or wax may be applied to the surface thereof, and where appropriate, be baked by heating with a heater or by driving the thermal head. In this case, application and baking of the lubricant or wax can be performed after the carbon protective layer 24*a*, 24*b* or 24*c* is etched with oxygen. The lubricant and the wax are not limited in any particular way, and a variety of types can be used. For example, a lubricant contained in the thermal material, a coating agent having heat resistance, preferably a coating agent excellent in lubricating properties are available.

Methods of forming the carbon protective layer 24*a*, 24*b* or 24*c* are not limited in any particular way and any known film deposition methods may be used in accordance with the composition of the carbon protective layer 24*a*, 24*b* or 24*c* to be formed. A preferred method is to form the carbon protective layer 24*a*, 24*b* or 24*c* by sputtering, especially magnetron sputtering, or CVD, especially plasma-assisted CVD, after the region in which the layer 24*a*, 24*b* or 24*c* is not to be formed is masked.

The carbon protective layer 24*a*, 24*b* or 24*c* may be formed while heating to about 50° C.–400° C., especially to a temperature at which the thermal head 10*a*, 10*b* or 10*c* is used. In this method, the adhesion of the carbon protective layer 24*a*, 24*b* or 24*c* to the intermediate layer and the lower protective layer 22 can be further improved, and more excellent durability can be imparted to the carbon protective layer 24*a*, 24*b* or 24*c* which is protected from cracking and delamination caused by a thermal shock and a mechanical impact due to a foreign matter entered during thermal recording, as well as alteration and attrition of the carbon protective layer 24*a*, 24*b* or 24*c* due to high power recording. It should be however noted that heating can be performed by a method using a heating device such as a heater, or a method of energizing the thermal head 10*a*, 10*b* or 10*c*.

Figure 2:
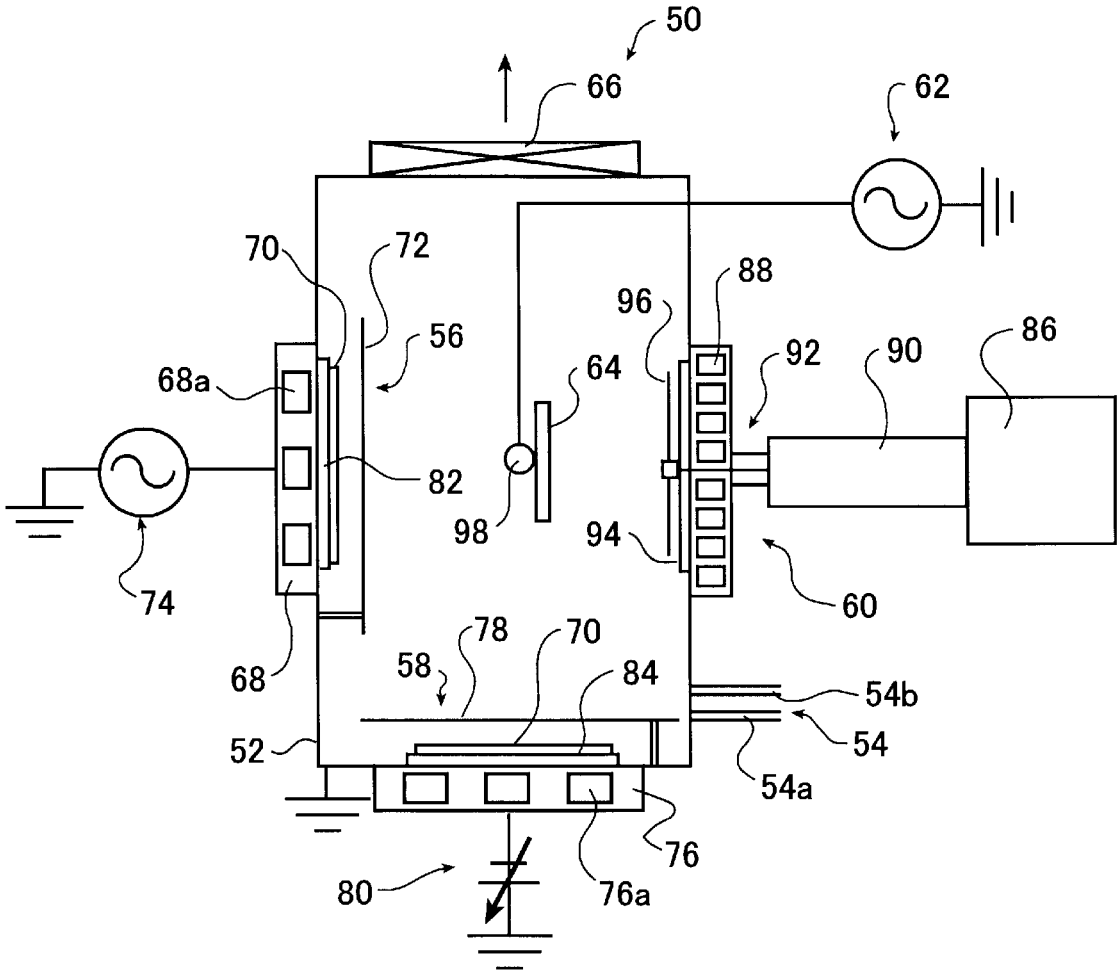
FIG. 2 is a conceptual view of an exemplary film deposition apparatus for use in fabricating the thermal head of the invention.

FIG. 2 shows the concept of a film deposition apparatus suitable for forming the protective coating of the thermal head 10*a*, 10*b* or 10*c* of the invention.

The illustrated film deposition apparatus generally indicated by 50 in FIG. 2 comprises a vacuum chamber 52, a gas introducing section 54, a first sputter device 56, a second sputter device 58, a plasma generating device 60, a bias source 62 and a substrate holder 64 as the basic components.

The film deposition apparatus 50 comprises three film deposition devices located in the system or the vacuum chamber 52, the two being performed by sputtering and the other by plasma-assisted CVD. A plurality of layers that are different in the composition can be formed continuously.

Therefore, the film deposition apparatus 50 can be used to form the lower protective layer 22 and the carbon protective layer 24*a*, 24*b* or 24*c*, and optionally the intermediate layer with a high efficiency by means of sputtering using different targets or the combination of sputtering with plasma-assisted CVD.

The vacuum chamber 52 is preferably formed of a non-magnetic material such as SUS 304. A vacuum pump-down device 66 is provided to evacuate the interior of the film deposition system to reduce the pressure. Those sites of the vacuum chamber 52 where plasma develops or an arc is produced by plasma generating electromagnetic waves may be covered with an insulating member, which may be made of insulating materials including MC nylon, Teflon (PTFE) or the like.

The gas introducing section 54 consists of two parts 54*a* and 54*b*, the former being a site for introducing a plasma generating gas and the latter for introducing a reactive gas for use in the plasma-assisted CVD, into the vacuum chamber 52.

Inert gases such as argon, helium and neon are used as the plasma generating gas.

Examples of the reactive gas for producing the carbon protective layer 24*a*, 24*b* or 24*c* are the gases of hydrocarbon compounds such as methane, ethane, propane, ethylene, acetylene and benzene. Examples of the reactive gas for producing the lower protective layer 22 are various gases including materials used to form the lower protective layer 22. Specifically, a mixed gas of silane, nitrogen and oxygen or the like can be used as the reactive gas when producing a silicon nitride layer as the lower protective layer 22.

To effect sputtering, a target 70 to be sputtered is placed on each of cathodes 68 and 76, which are rendered at negative potential and a plasma is generated on the surface of the target 70, whereby atoms are struck out of the target 70 and deposit on the surface on the opposed substrate to form the coating.

The first sputter device 56 and the second sputter device 58 are both intended for sputtering film deposition on the surface of the substrate. The former comprises the cathode 68, the area where the target 70 is to be placed, a shutter 72, a radio-frequency (RF) power supply 74 and other components. The latter comprises the cathode 76, the area where the target 70 is to be placed, a shutter 78, a direct current (DC) power supply 80 and other components.

As seen from the above configuration, the first sputter device 56 and the second sputter device 58 have basically a similar configuration except that the power supply and the positions of the respective components are different. Therefore, we now describe the first sputter device 56 as a typical example except for the different portions.

In order to generate plasma on the surface of the target 70 in the second sputter device 58, the negative side of the DC power supply 80 is directly connected to the cathode 76, and sputtering voltage is applied.

The output and performance of the two power supplies are not limited in any particular way, and a device having the necessary and sufficient performance to produce a layer of interest can be selected. In case of an apparatus used to form the carbon protective layer 24*a*, 24*b* or 24*c* for example, a DC power supply can be used which is at negative potential capable of producing a maximal output of 10 kW, and which is adapted to be capable of pulse modulation at frequencies in the range of 2 to 100 kHz by means of a modulator.

In the illustrated case, a backing plate 82 (or 84 in the second sputter device 58) made of oxygen-free copper, stainless steel or the like is first fixed to the cathode 68 and the target 70 is then attached to the backing plate 82 with In-based solder or by a mechanical fixing device.

Preferred materials of the target 70 used to form the lower protective layer 22 include various ceramic materials such as $Si_3N_4$ and SIALON as described above. The target 70 used to form the carbon protective layer 24*a*, 24*b* or 24*c* is preferably made of sintered carbon, glassy carbon or the like.

The illustrated apparatus performs magnetron sputtering, in which magnets 68*a* (or 76*a*) are placed within the cathode 68 and sputtering plasma is confined within a magnetic field formed on the surface of the target 70. Magnetron sputtering is preferred since it achieves high deposition rates.

The illustrated film deposition apparatus 50 is used to form the carbon protective layer 24*a*, 24*b* or 24*c* by means of the plasma-assisted CVD with microwave ECR discharge which generate plasma with microwave in the ECR magnetic field. The plasma generating device 60 comprises a microwave source 86, magnets 88, a microwave guide 90, a coaxial transformer 92, a dielectric plate 94 and a radial antenna 96 and the like.

A source having the necessary and sufficient output to produce the carbon protective layer 24*a*, 24*b* or 24*c* can appropriately be selected as the microwave source 86. Permanent magnets or electromagnets capable of forming a desired magnetic field can be appropriately used as the magnets 88 for generating the ECR magnetic field. The microwave is introduced into the vacuum chamber 52 by means of the microwave guide 90, the coaxial transformer 92, the dielectric plate 94 and the like.

The substrate holder 64 is used to fix the portion to be coated in the thermal head 10*a*, 10*b* or 10*c* (or the substrate) in position. The film deposition apparatus 50 as shown in FIG. 2 comprises these three film deposition devices. The substrate holder 64 is held on a rotary base 98 which rotates to move the substrate holder 64 so that the glaze on the substrate holder 64 can be opposed to the respective film deposition devices, that is, the sputter devices 56 and 58, and the plasma generating device 60 by means of the plasma-assisted CVD.

The distance between the substrate holder 64 and the target 70 or the radial antenna 96 can be adjusted by a known method and a distance that provides a uniform thickness profile may be set appropriately.

As described above, the surface of the lower protective layer 22 is roughened as required by etching. In addition, film deposition is preferably performed with a negative bias voltage being applied to the substrate in order to obtain a hard coating by the plasma-assisted CVD.

To do this, the bias source 62 that applies a radio-frequency voltage to the substrate is connected to the substrate holder 64 in the film deposition apparatus 50. A radio-frequency self-bias voltage is preferably used in the plasma-assisted CVD.

On the foregoing pages, the thermal head of the invention has been described in detail but the present invention is in no way limited to the stated embodiments and various improvements and modifications can of course be made without departing from the spirit and scope of the invention.

As described above in detail, the present invention provides a thermal head having an electrically conductive protective layer such as a carbon protective layer that prevents abnormal current from flowing through the electrically conductive protective layer due to pinholes formed in the insulating protective layer neighboring the electrode layers, thereby ensuring that high reliability can be exhibited over an extended period of operation without malfunction of the thermal head or breakage of the drive IC.

The invention will be further illustrated by means of the following specific examples.

EXAMPLES

As in conventional methods of fabricating a thermal head, the heat-accumulating layer 14 was formed on the substrate 12, after which the heater 16, the positive electrode layer 18 and the negative electrode layer 20 were formed on the substrate 12 and the layer 14 by sputtering, and a pattern was formed by photolithography and etching. A thermal head having no protective coating was thus fabricated.

According to the procedure described below, a silicon nitride ($Si_3N_4$) layer having a thickness of 7 $\mu$m was formed as the lower protective layer 22 on the thermal head obtained.

Formation of Lower Protective Layer 22:

A conventional sputter device was used to perform film deposition by magnetron sputtering with an RF power of from 2 to 5 kW.

A SiN sintering agent was used as the target.

As for the gases to be introduced into the chamber for sputtering, 100 sccm of argon was used as the carrier gas, and 20 sccm of nitrogen gas and 5 sccm of oxygen gas were used as the reactive gas. The total gas pressure (the internal pressure of the chamber) was adjusted to 5 mTorr.

Formation of Carbon Protective Layer 24*a*, 24*b* or 24*c*:

The film deposition apparatus 50 described below and shown in FIG. 2 was used to form the carbon protective layer 24*a*, 24*b* or 24*c* on the lower protective layer 22 of the thermal head.

Film Deposition Apparatus 50:

a. Vacuum Chamber 52

The vacuum chamber 52 made of SUS 304 and having a capacity of 0.5 $m^3$ was used; the vacuum pump-down device 66 comprised one unit each of a rotary pump having a pumping speed of 1,500 L/min, a mechanical booster pump having a pumping speed of 12,000 L/min and a turbomolecular pump having a pumping speed of 3,000 L/sec. An orifice valve was fitted at the suction inlet of the turbomolecular pump to allow for 10 to 100% adjustment of the degree of opening.

b. Gas Introducing Section 54

A mass flow controller permitting a maximum flow rate of 50 to 500 sccm and a stainless steel pipe having a diameter of 6 mm were used to form two gas introducing parts 54*a* and 54*b*, the former being used for introducing a plasma generating gas and the latter being used for introducing a reactive gas.

c. First and Second Sputter Devices 56, 58

The cathodes 68 and 76 used were in a rectangular form having a width of 600 mm and a height of 200 mm, with Sm—Co magnets being incorporated as the permanent magnets 68*a* and 76*a*. The backing plates 82 and 84 were rectangular oxygen-free copper members, which were attached to the cathodes 68 and 76 with In-based solder. The interior of the cathodes 68 and 76 was water-cooled to cool the magnets 68*a* and 76*a*, the cathodes 68 and 76 and the rear side of each of the backing plates 82 and 84.

The RF power supply 74 used had a frequency of 13.56 MHz and could produce a maximal output of 10 kW. The DC power supply 80 used was at negative potential capable of producing a maximal output of 10 kW. The DC power supply 80 was adapted to be capable of pulse modulation at frequencies in the range of 2 to 100 kHz in combination with the modulator.

d. Plasma Generating Device 60

The microwave source 86 oscillating at a frequency of 2.45 GHz and producing a maximal output of 1.5 kW was employed. The generated microwave was guided to the neighborhood of the vacuum chamber 52 by means of the microwave guide 90, converted in the coaxial transformer 92 and directed to the radial antenna 96 in the vacuum chamber 52. The plasma generating part used was in a rectangular form having a width of 600 mm and a height of 200 mm.

A magnetic field for ECR was produced by arranging a plurality of Sm—Co magnets used as the magnets 88 in a pattern to conform to the shape of the dielectric plate 94.

e. Substrate Holder 64

The rotary base 98 was rotated to move the substrate holder 64 so that the substrate (the thermal head 10*a*, 10*b* or 10*c*) fixed thereon is kept opposed to one of the targets 70 in the first and second sputter devices 56 and 58 and the radial antenna 96 in the plasma generating device 60. The distance between the substrate and each target 70 was set at 100 mm when forming the carbon protective layer 24*a*, 24*b* or 24*c* by sputtering as described below.

In addition, the area of the substrate holder 64 in which the thermal head was held was set at a floating potential in order to enable the application of an etching radio-frequency voltage. A heater was also provided on the surface of the substrate holder 64 for film deposition with heating.

f. Bias Source 62

An RF power supply was connected to the substrate holder 64 via the matching box.

The RF power supply had a frequency of 13.56 MHz and could produce a maximal output of 3 kW. It was also adapted to be such that by monitoring the self-bias voltage, the RF output could be adjusted over the range of −100 to −500 V.

In this apparatus 50, the bias source 62 also serves as the etching device.

Formation of Carbon Protective Layer 24*a*, 24*b* or 24*c*:

In the film deposition apparatus 50, the thermal head 10*a*, 10*b* or 10*c* was secured to the substrate holder 64 such that the heating elements (lower protective layer 22) would be kept opposed to the target 70 positioned in the second sputter device 58.

With continued pump-down by means of the vacuum pump-down device 66, argon gas was introduced through the gas introducing section 54 and the pressure in the vacuum chamber 52 was adjusted to $5.0\times10^{-3}$ Torr by means of the orifice valve fitted on the turbomolecular pump. Subsequently, a radio-frequency voltage was applied to the substrate and the lower protective layer 22 (silicon nitride layer) was etched for 10 minutes at a self-bias voltage of −300 V.

After the end of etching, a sintered graphite member was fixed (i.e., attached by means of In-based solder) on the backing plate 84 in the second sputter device 58. Then, the argon gas flow rate and the orifice valve were adjusted so as to maintain the internal pressure in the vacuum chamber 52 at $2.5\times10^{-3}$ Torr, and a DC power of 0.5 kW was applied to the target 70 for five minutes, with the shutter 78 being closed.

Subsequently, with the internal pressure in the vacuum chamber 52 kept at the stated level, the DC power was raised to 5 kW and the shutter 78 was opened. The sputtering was performed to form the carbon protective layer 24*a*, 24*b* or 24*c* having a thickness of 2 $\mu$m.

To control the thickness of the carbon protective layer 24*a*, 24*b* or 24*c* being formed, the deposition rate was determined previously and the time required to reach a specified layer thickness was calculated.

Prior to forming the carbon protective layer 24*a*, 24*b* or 24*c*, masking was performed with a stainless steel mask, thereby obtaining the thermal head 10*a* having the carbon protective layer 24*a* as shown in FIG. 1A (Example 1), the thermal head 10*b* having the carbon protective layer 24*b* as shown in FIG. 1B (Example 2), and the thermal head 10*c* having the carbon protective layer 24*c* as shown in FIG. 1C (Example 3).

Figure 3:
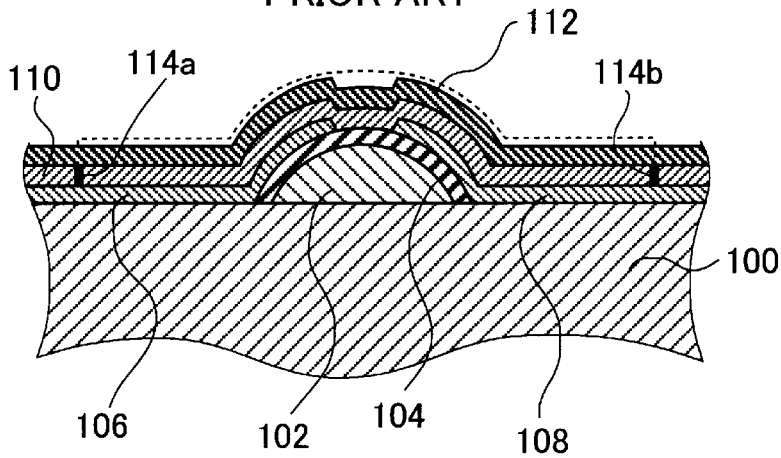
FIG. 3 PRIOR ART
FIG. 3 is a schematic cross sectional view showing the structure of a heating element in a conventional thermal head.

As a comparative example, a carbon protective layer 112 was formed without masking, whereby a conventional thermal head having the carbon protective layer 112 formed on the entire surface of a lower protective layer 110 was also fabricated as shown in FIG. 3.

Evaluation of Performance:

The thus fabricated four samples of thermal head (Examples 1, 2 and 3, and Comparative Example 1) were subjected to running test for solid recording of 2 kw.

The results showed that any defects including malfunction of the thermal head and breakage of the drive IC did not occurred in Examples 1, 2 and 3, whereas malfunction of the thermal head was already found before the end of 2 km recording in Comparative Example 1.

These results clearly demonstrate the effectiveness of the thermal head of the present invention.

What is claimed is:

1. A thermal head comprising:

at least one heating element, at least one negative electrode layer and at least one positive electrode layer formed on said heating element, a protective coating formed on said heating element, and an under-glaze heat-accumulating layer formed under said heating element, wherein said protective coating includes:

an insulating protective layer formed on said negative electrode layer and said positive electrode layer, and an electrically conductive protective layer formed above said insulating protective layer, wherein said electrically conductive protective layer covers a first region of said insulating protective layer under which said under-glaze heat-accumulating layer is located and does not overlie other regions of said insulating protective layer than said first region.

2. The thermal head according to claim 1, wherein said insulating protective layer and said electrically conductive protective layer are based on ceramics and carbon, respectively.

3. The thermal head according to claim 2, further comprising:

an intermediate layer provided between said insulating protective layer and said electrically conductive protective layer.

4. The thermal head according to claim 1, further comprising:

an intermediate layer provided between said insulating protective layer and said electrically conductive protective layer.

5. A thermal head comprising:

at least one heating element, at least one negative electrode layer and at least one positive electrode layer formed on said heating element, a protective coating formed on said heating element, and an under-glaze heat-accumulating layer formed under said heating element, wherein said protective coating includes:

an insulating protective layer formed on said negative electrode layer and said positive electrode layer, and an electrically conductive protective layer formed above said insulating protective layer, wherein said electrically conductive protective layer covers a region of said insulating protective layer under which said under-glaze heat-accumulating layer and said negative electrode layer are located and does not overlie an area of said insulating protective layer where said positive electrode layer alone is disposed.

* * * * *